US010788032B2

(12) United States Patent
Baumgarte et al.

(10) Patent No.: US 10,788,032 B2
(45) Date of Patent: Sep. 29, 2020

(54) PISTON ARRANGEMENT FOR PUMPING A LIQUID

(71) Applicant: KHS Corpoplast GmbH, Hamburg (DE)

(72) Inventors: Rolf Baumgarte, Ahrensburg (DE); Ludwig Clüsserath, Bad Kreuznach (DE); Werner Lesinski, Ahrensburg (DE); Michael Linke, Hamburg (DE); Michael Litzenberg, Geesthacht (DE); Niels Meyer, Schenefeld (DE)

(73) Assignee: KHS Corpoplast GmbH, Hamburg (DE)

( * ) Notice: Subject to any disclaimer, the term of this patent is extended or adjusted under 35 U.S.C. 154(b) by 171 days.

(21) Appl. No.: 15/521,887

(22) PCT Filed: Oct. 30, 2015

(86) PCT No.: PCT/EP2015/002182

§ 371 (c)(1),
(2) Date: Apr. 25, 2017

(87) PCT Pub. No.: WO2016/066275

PCT Pub. Date: May 6, 2016

(65) Prior Publication Data

US 2018/0135618 A1 May 17, 2018

(30) Foreign Application Priority Data

Oct. 30, 2014 (DE) ..... 10 2014 016 141

(51) Int. Cl.
*F04B 53/00* (2006.01)
*F04B 53/14* (2006.01)
(Continued)

(52) U.S. Cl.
CPC ..... *F04B 53/008* (2013.01); *F04B 53/143* (2013.01); *F04B 53/16* (2013.01); *F04B 53/22* (2013.01)

(58) Field of Classification Search
CPC ..... F04B 53/008; F04B 53/143; F04B 53/16; F04B 53/22
(Continued)

(56) References Cited

U.S. PATENT DOCUMENTS 3,922,115 A * 11/1975 Coe ..... F04B 9/02 417/374
4,699,297 A * 10/1987 Raque ..... B65B 3/32 141/90
(Continued)

FOREIGN PATENT DOCUMENTS

DE 2064074 A1 7/1971
DE 4007832 A1 9/1990
(Continued)

*Primary Examiner* — Connor J Tremarche
(74) *Attorney, Agent, or Firm* — Rankin, Hill & Clark LLP

(57) ABSTRACT

The present invention relates to a piston assembly for pumping a liquid, in particular in a bottle filling system. The object of the invention is to propose a piston assembly for pumping a liquid, which can be cleaned and/or disinfected without dismantling of the piston or performing any other external interventions into the assembly. The object is achieved by a piston assembly for pumping a liquid, which comprises a piston 1 that travels within a cylinder 2 and has a working path A between a first inversion point U1 and a second inversion point U2, with the piston 1 forming a tight seal with respect to the cylinder 2 in the region of the working path. The assembly is characterized in that beyond one of the two inversion points U1, U2, outside of the working path A, the diameter of the cylinder 2 is enlarged in one section 8 such that the sealing closure is eliminated there, and the piston 1 can be moved into this area for a cleaning and/or disinfection process.

11 Claims, 14 Drawing Sheets

(51) Int. Cl.
*F04B 53/16* (2006.01)
*F04B 53/22* (2006.01)

(58) Field of Classification Search
USPC ..... 417/567
See application file for complete search history.

(56) References Cited

U.S. PATENT DOCUMENTS

| | | | | |
|---|---|---|---|---|
| 4,860,926 | A * | 8/1989 | Juenkersfeld | B65B 3/32 222/148 |
| 5,947,001 | A * | 9/1999 | Evans, Jr. | F15B 15/1447 91/1 |
| 2005/0152787 | A1* | 7/2005 | Oglesby | F04B 15/02 417/18 |
| 2011/0085934 | A1* | 4/2011 | Joshi | A23L 3/3409 422/5 |
| 2013/0199490 | A1* | 8/2013 | Schramm | B23P 6/02 123/195 R |
| 2014/0260565 | A1* | 9/2014 | Imamura | F04B 13/00 73/61.56 |

FOREIGN PATENT DOCUMENTS

| | | | |
|---|---|---|---|
| DE | 4025714 | A1 | 2/1992 |
| EP | 0229304 | A1 | 7/1987 |
| JP | 2000335503 | A | 12/2000 |
| JP | 2009029500 | A | 2/2009 |

* cited by examiner

PISTON ARRANGEMENT FOR PUMPING A LIQUID

The present invention relates to a piston assembly for pumping a liquid, in particular in a bottle filling system.

For the process of filling liquids into containers such as bottles, various methods for feeding in the filling material are available, depending on the pressure that is required and the measurement method that is used to ensure that each container is filled with a sufficient volume of filling material.

One method that can be used with volumetric filling, in particular, involves the use of a piston, which performs stroke movements within a cylinder and displaces a defined volume of liquid with each stroke. For instance, with a first stroke movement of the piston, a defined volume can be drawn from a reservoir through a feed line and into the piston. The feed line is then closed by a shut-off valve, which may also be designed as a non-return valve, so that liquid is prevented from flowing back into the reservoir.

The liquid inside the cylinder is then displaced from the cylinder in the opposite direction by a piston stroke and is fed through a line into the container to be filled. Depending on the molding and filling process and on the filling material being bottled, this process can be carried out under various pressures. This method can be used both for filling a container that has already been shaped and for simultaneously molding and filling a preform under high pressure.

One problem with the use of such piston pumps is the cleaning process that is involved. Strict hygiene standards must be observed in particular with bottle filling systems for bottling beverages. This includes regular cleaning and disinfection, however it is desirable for these processes to be carried out as quickly as possible in order to avoid long down times for the machine in question. It is also desirable, wherever possible, to avoid external intervention into machinery, such as dismantling parts for cleaning and disinfection, to avoid contaminating the machinery with bacteria introduced from the outside. Areas of a machine that are used for conveying filling material should be isolated from the environment wherever possible and cleaned without being opened up.

To allow such machines to be cleaned and disinfected without disassembly wherever possible, various methods for what is known as "cleaning in place" have been developed, in which the components remain in place.

However, the cleaning and disinfection of the piston and cylinder in a piston assembly for pumping a liquid remain problematic in that it is typically necessary to dismantle the piston in order to remove contaminants between the piston and the cylinder. In particular, in pistons that are provided with a seal in relation to the cylinder working surface, contaminants in the region of the seal can be removed only inadequately without disassembly.

It is therefore the object of the present invention to propose a piston assembly for pumping a liquid, which can be cleaned and/or disinfected without dismantling the piston or carrying out other external interventions into the assembly.

According to the invention, a piston assembly for pumping a liquid, in particular in a bottle filling system, is proposed, which comprises a piston that travels within a cylinder and has a working path between a first inversion point and a second inversion point, with the piston forming a tight seal with respect to the cylinder in the region of the working path. The assembly according to the invention is characterized in that, beyond one of the two inversion points, outside of the working path, the diameter of the cylinder is enlarged in one section such that the sealing closure is eliminated there, and the piston can be moved into this area for a cleaning and/or disinfection process.

With the assembly according to the invention, liquid can be pumped from a feed line into a container by moving the piston between two inversion points. The volume that is fed to the container is determined by the working path of the piston and by the diameter of the cylinder. Piston and cylinder form a tight seal with one another for this purpose. This can be accomplished without seals by providing precise clearances between piston and cylinder with a non-contact gap seal, or by means of a seal provided on the piston in relation to the working path in the cylinder.

According to the invention, beyond one of the two inversion points, outside of the working path, the diameter of the cylinder is to be enlarged in one section. The cylinder diameter is to be enlarged in such a way that the sealing closure is eliminated there. It should further be possible for the piston to be moved into this area for a cleaning and/or disinfection process.

During normal operation, the piston describes strokes between the two inversion points, thereby pumping a defined volume of a liquid from a reservoir into a container. For cleaning and/or disinfection, the piston is then moved into the area of the cylinder that has the enlarged diameter, which acts as a cleaning chamber. Depending on the medium that is used, the piston may also be disinfected there. For the sake of simplicity, the term cleaning chamber will be used throughout here, even though the same chamber may be used for disinfection.

In the cleaning chamber, the sealing action of the piston in relation to the cylinder wall is eliminated, and a cleaning and/or disinfecting medium can be applied to the piston and cylinder working surface, including any seals that may be provided there. It is no longer necessary to dismantle the assembly or to carry out any other external intervention.

Since there is no longer any contact between the piston and the cylinder in the area with the enlarged diameter in the cleaning chamber, it is not necessary for this area to be cylindrical in shape, although this may be advantageous. For the sake of simplicity, the term cylinder will be used throughout here, although it will be obvious to a person skilled in the art that areas in which the piston and cylinder have no contact do not necessarily have to be cylindrical in shape, and may instead also be oval, polygonal or any other desired shape. The crucial feature is that the diameter must be enlarged such that there is no longer any sealing action between the piston and the cylinder.

Suitable cleaning and/or disinfecting media are, in particular, liquid or foaming media. It is also possible for steam to be supplied.

In an advantageous embodiment of the invention, the diameter of the cylinder is enlarged by means of continuous transitions and/or large radii. This ensures that the piston can be moved from the cleaning position into its working area without becoming caught or jammed.

In a further advantageous embodiment of the invention, the section of the cylinder with an enlarged diameter is equipped with nozzles for supplying a cleaning and/or disinfecting medium. These allow cleaning and/or disinfecting medium to be introduced into the cleaning chamber in a targeted manner. This embodiment is particularly advantageous if the piston is provided with a circumferential seal and if cleaning and/or disinfecting medium can be applied directly to this area of the piston in a targeted manner.

The piston and the seal can advantageously be designed as integral, so that there are no hidden areas that are difficult to clean and disinfect. In particular, the seal can be a sealing lip that surrounds the piston. The piston and seal can be made of plastic, in particular of polyethylene (PE), polypropylene (PP) or polyethylene terephthalate (PET).

According to one embodiment of the invention, beyond the cylinder section with the enlarged diameter, the diameter of the cylinder can return to the diameter of the working path area. More particularly, a tight seal can be formed between piston and cylinder beyond the cylinder section with the enlarged diameter. This design allows a correspondingly configured piston to be moved into the cleaning and/or disinfecting position, in which the cleaning and/or disinfecting medium can be applied to the areas of the piston to be cleaned and/or disinfected, while the piston forms a tight seal with the area that lies beyond the cleaning chamber, thereby preventing any cleaning and/or disinfecting medium from penetrating to the outside.

The piston assembly can advantageously have one liquid line and two valves arranged in the liquid line. In particular, at least one of said valves can be embodied as a non-return valve. However, the valves may also be regulated or controlled in any other way, of course.

One of the valves may be arranged in the liquid line upstream of the piston and/or one valve may be arranged downstream of the piston. Alternatively, one valve may also be disposed inside the piston. In that case, liquid can be fed in through the piston.

It will be obvious to a person skilled in the art that the invention described above and in the following exemplary embodiments is not limited to pistons of pumps. In principle, the invention can be generalized for any application in which a cylindrical body travels within and forms a tight seal with a corresponding sleeve. For instance, the assembly of the invention can be readily applied, for example, to a drawing bar that is movable within a sleeve in a machine for molding containers, or similar applications. These applications are also covered by the subject matter of this application.

Various exemplary embodiments of the invention will be explained in greater detail in the following, with reference to the accompanying figures, in which:

FIGS. 1*a* and 1*b* are schematic cross-sectional diagrams of a first embodiment of a piston assembly according to the invention for a bottle filling machine, in the working position and in the cleaning and/or disinfecting position, respectively;

FIGS. 2*a* and 2*b* are schematic cross-sectional diagrams of a second embodiment of a piston assembly according to the invention, in the working position and in the cleaning and/or disinfecting position, respectively;

FIGS. 3*a* and 3*b* are schematic cross-sectional diagrams of a third embodiment of a piston assembly according to the invention, in the working position and in the cleaning and/or disinfecting position, respectively;

FIGS. 4*a* and 4*b* are schematic cross-sectional diagrams of a fourth embodiment of a piston assembly according to the invention, in the working position and in the cleaning and/or disinfecting position, respectively;

It will be obvious to a person skilled in the art that the drawings shown here are intended merely to illustrate the principle of the invention and are rendered only schematically and not to scale. In particular, the represented dimensions of the piston and all other dimensions are for illustrative purposes only. The actual dimensions and proportions may be freely determined by a person skilled in the art based on his knowledge in the art.

Figure 1A:
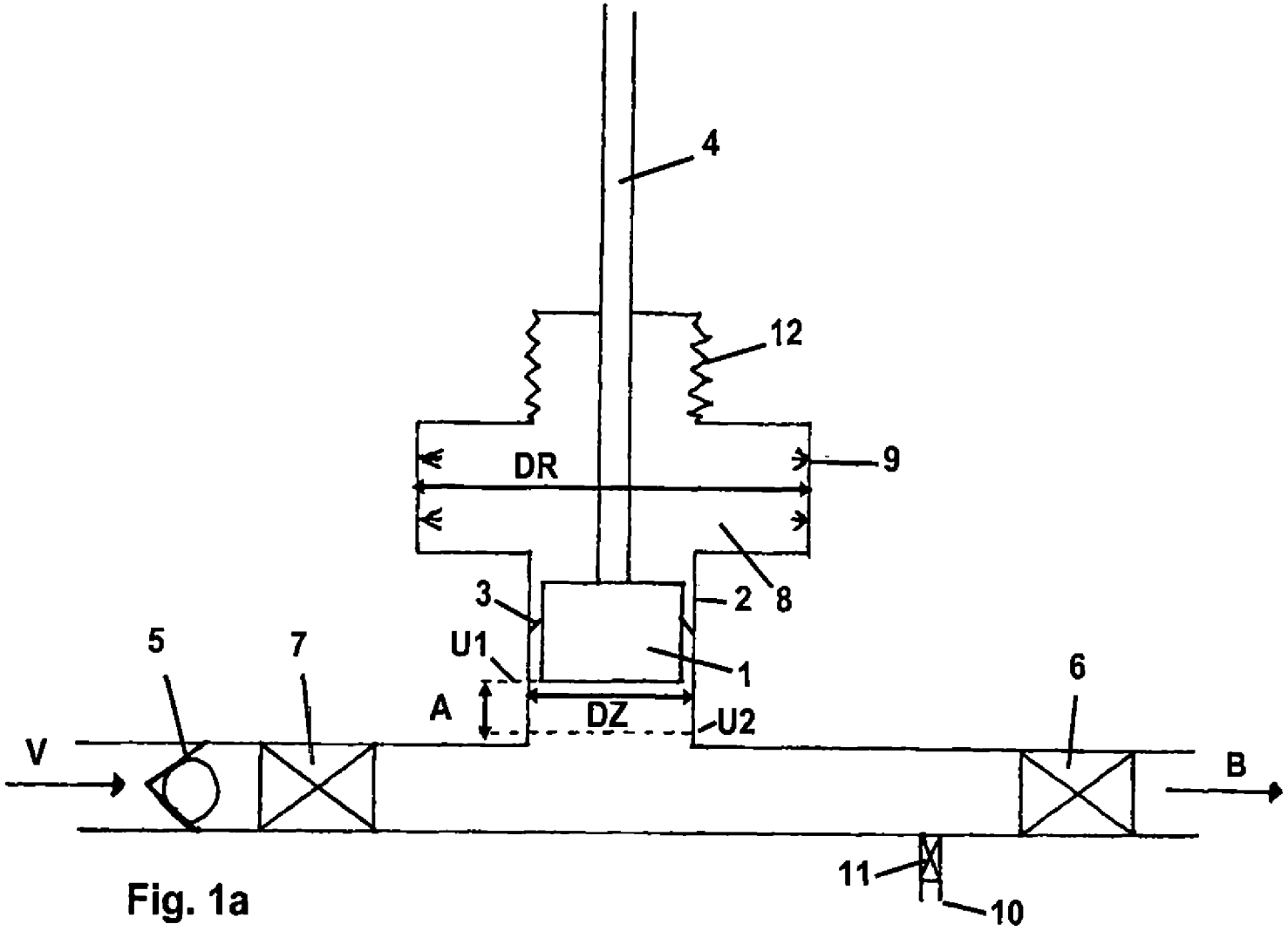

FIG. 1*a* is a schematic diagram of an exemplary embodiment of a piston assembly according to the invention, by means of which liquid filling material can be drawn from a reservoir (not shown) and fed into a container. For this purpose, a piston 1 is arranged in a cylinder 2. The piston forms a tight seal with respect to the working surface of cylinder 2 by means of lip seal 3. In the working position, the piston moves along a working path A between a first inversion point U1 and a second inversion point U2. The diameter DZ of the cylinder and the length of working path A are dimensioned such that during the downward movement of piston 1 from first inversion point U1 to second inversion point U2, the piston displaces the volume that is to be filled into the container.

In this process, piston 1 may be driven by any type of drive 4. The force that is required for this purpose is dependent on the amount of pressure that is required for filling the filling material. This process is suitable in principle for all standard filling or molding and filling processes. Non-carbonated beverages can be filled at relatively low pressure, while carbonated beverages require a somewhat higher pressure. If a container will be molded from a preform simultaneously with the filling process, significantly higher pressure is required.

As piston 1 moves upward from lower inversion point U2 to upper inversion point U1, and with shut-off valve 7 open, the piston draws filling material from a reservoir (not shown) through non-return valve 5, with the filling material flowing out of the reservoir in the direction of arrow V. Filling valve 6 is closed during this step.

To fill the container, filling valve 6 is opened and the piston is moved from upper inversion point U1 to lower inversion point U2. The filling material flows in the direction of arrow B to the container (not shown here).

The assembly is equipped with a cleaning chamber 8, in this case situated above the working path of piston 1, in which the diameter DR of the cylinder is enlarged such that the piston no longer forms a tight seal in relation to the cylinder. As is clear from FIG. 1*b*, in the cleaning chamber piston 1 is freely accessible from all sides and can be acted on by a cleaning and/or disinfecting medium. Nozzles 9 are provided for this purpose in the cleaning chamber.

Figure 1B:
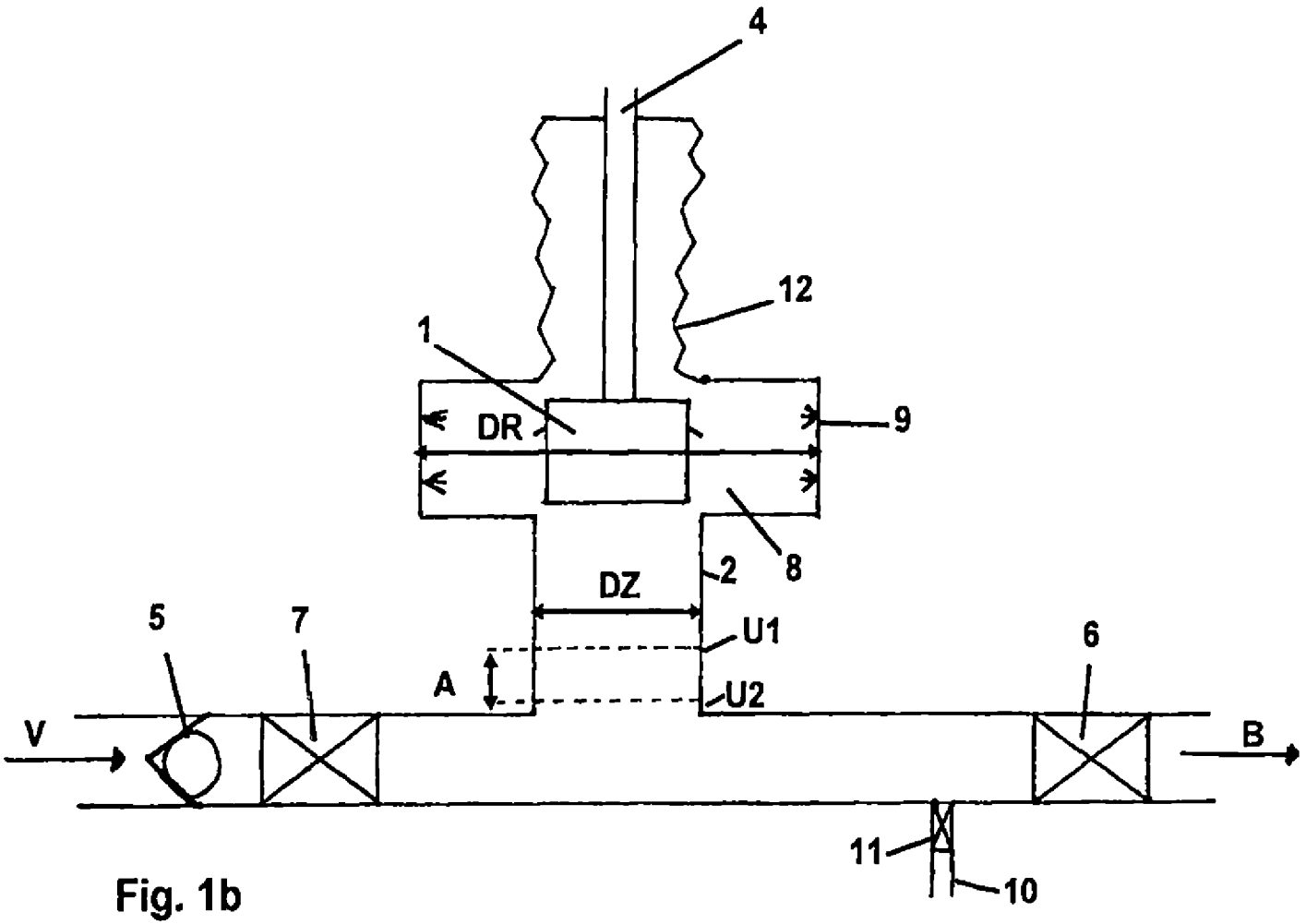

When the piston assembly will be cleaned, the inlet and outlet lines are closed by means of valves 6 and 7. As illustrated in FIG. 1*b*, piston 1 is moved upward into cleaning chamber 8, and cleaning and disinfecting medium is fed in through nozzles 9. Cleaning and disinfecting may be carried out in multiple steps using various media. The introduced cleaning and disinfecting media flow through the assembly and are removed via drain line 10, for which purpose valve 11 of drain line 10 is opened. Once cleaning and disinfection are completed, and if necessary following an additional rinsing step, the machine can be returned to operation by lowering piston 1 to the working position, closing valve 11 of drain line 10, and reopening valve 7 of the feed line.

To close off cleaning chamber 8 from the exterior, drive 4 of piston 1 is guided through a bellows 12 that seals off chamber 8.

Figure 2A:
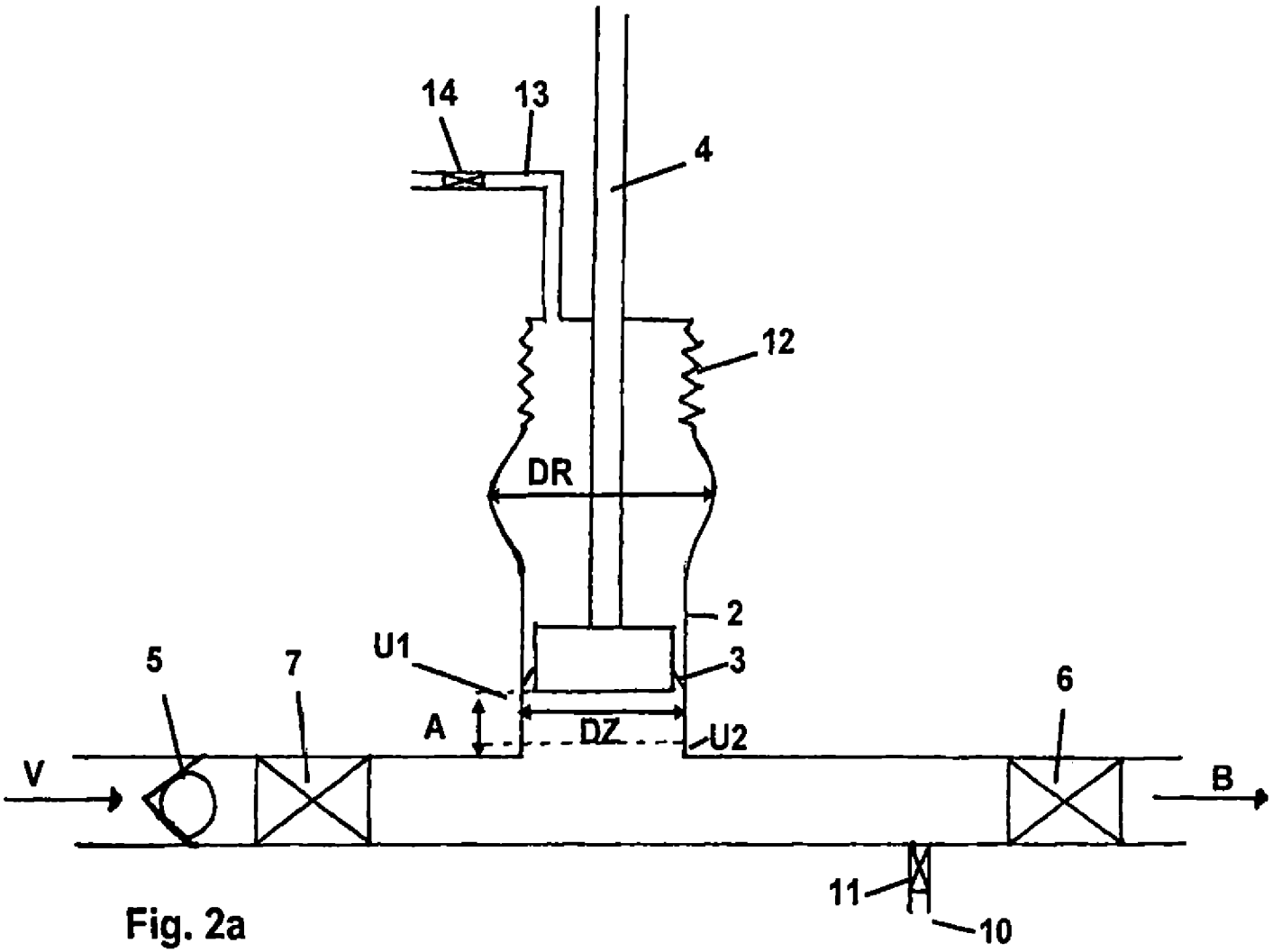
Figure 2B:
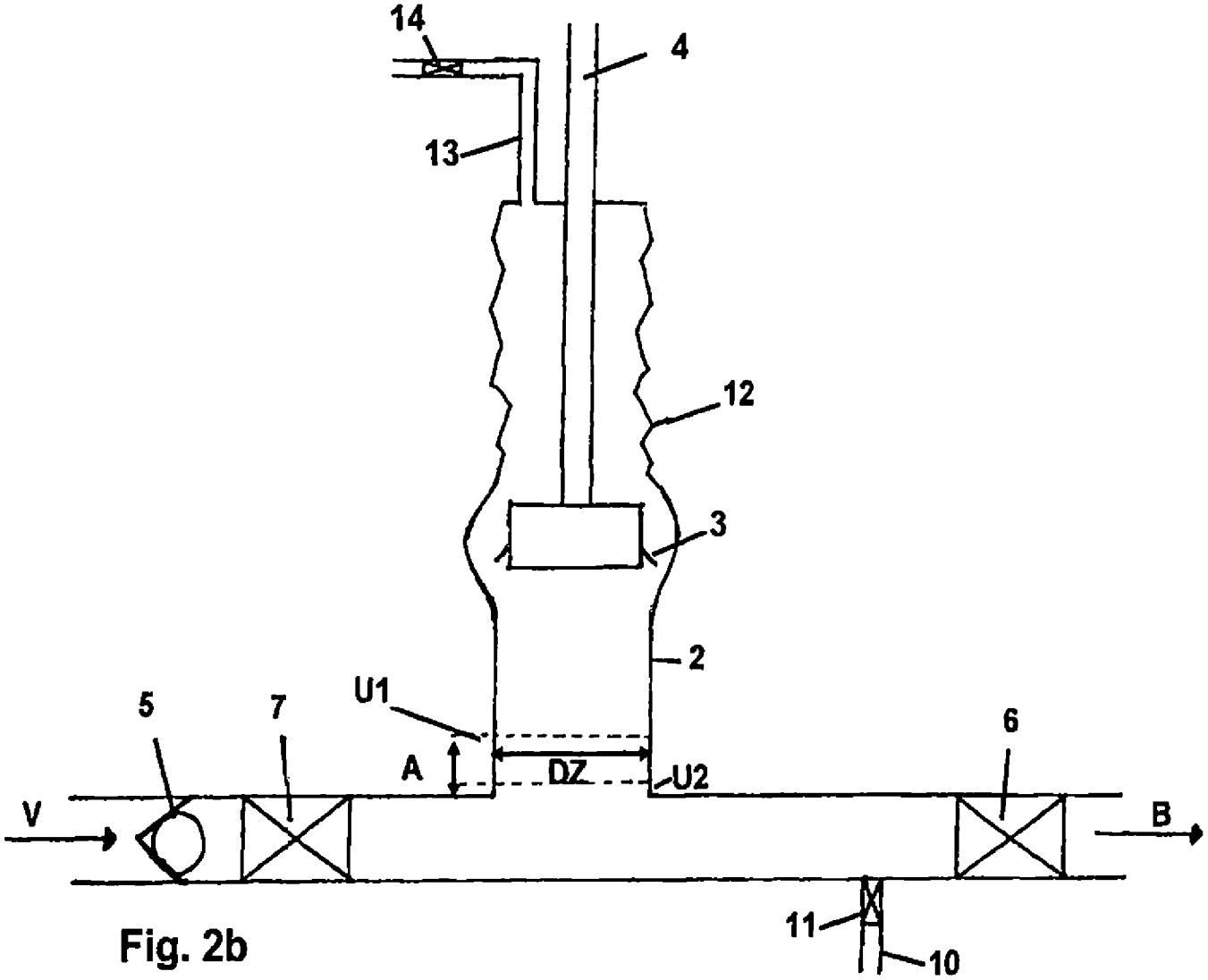

FIGS. 2*a* and 2*b* show a further exemplary embodiment of the assembly according to the invention, which corresponds largely to the exemplary embodiment shown in FIGS. 1*a* and 1*b*. Again, FIG. 2*a* shows the assembly in the working position and FIG. 2*b* shows the assembly in the cleaning position.

In contrast to FIG. 1, however, diameter DR of cylinder 2 is enlarged by means of continuous transitions and large radii, so that no edges are formed. Piston 1 can slide downward from its cleaning position to its working position without becoming caught or jammed.

In this exemplary embodiment, cleaning and/or disinfecting media are supplied via feed line 13 and shut-off valve 14.

Figure 3A:
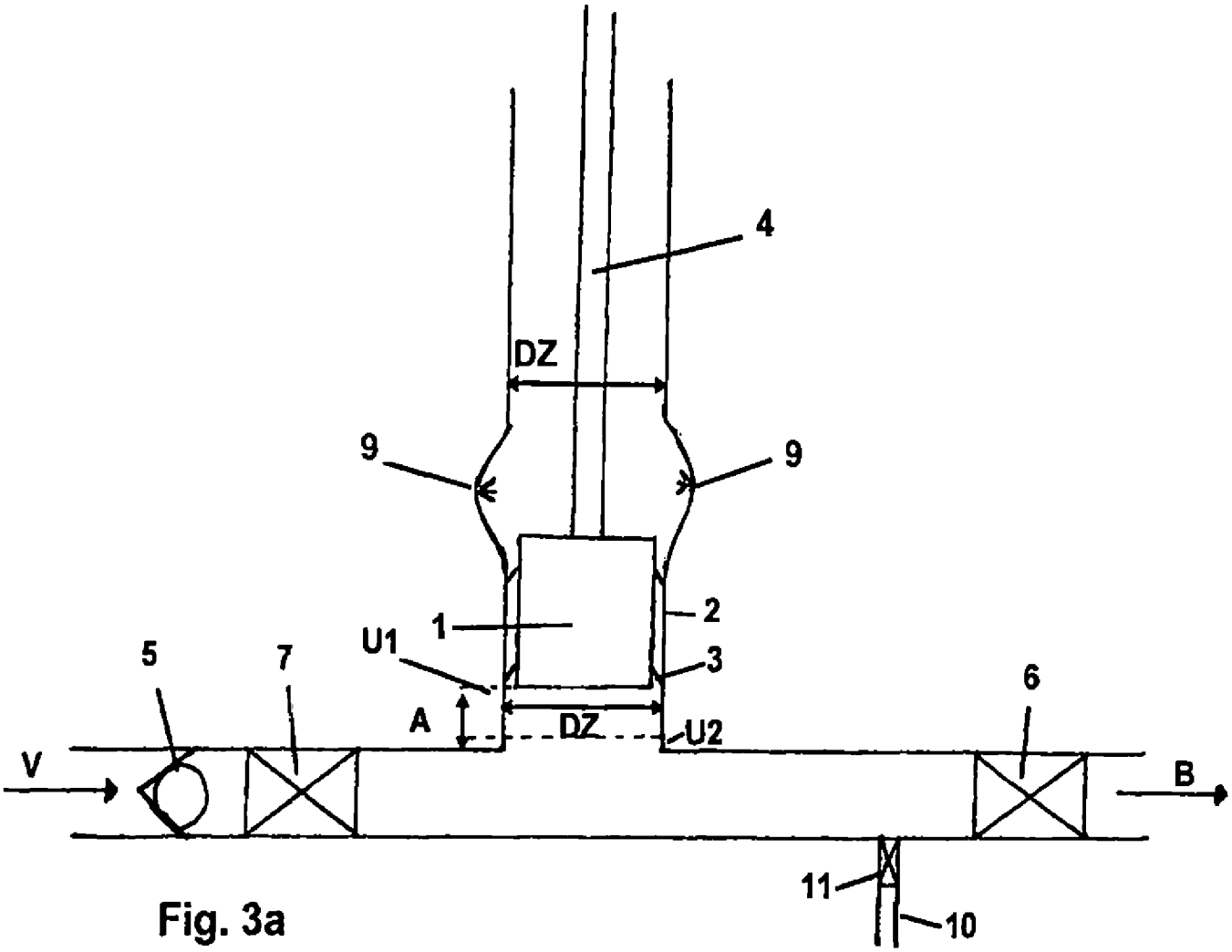
Figure 3B:
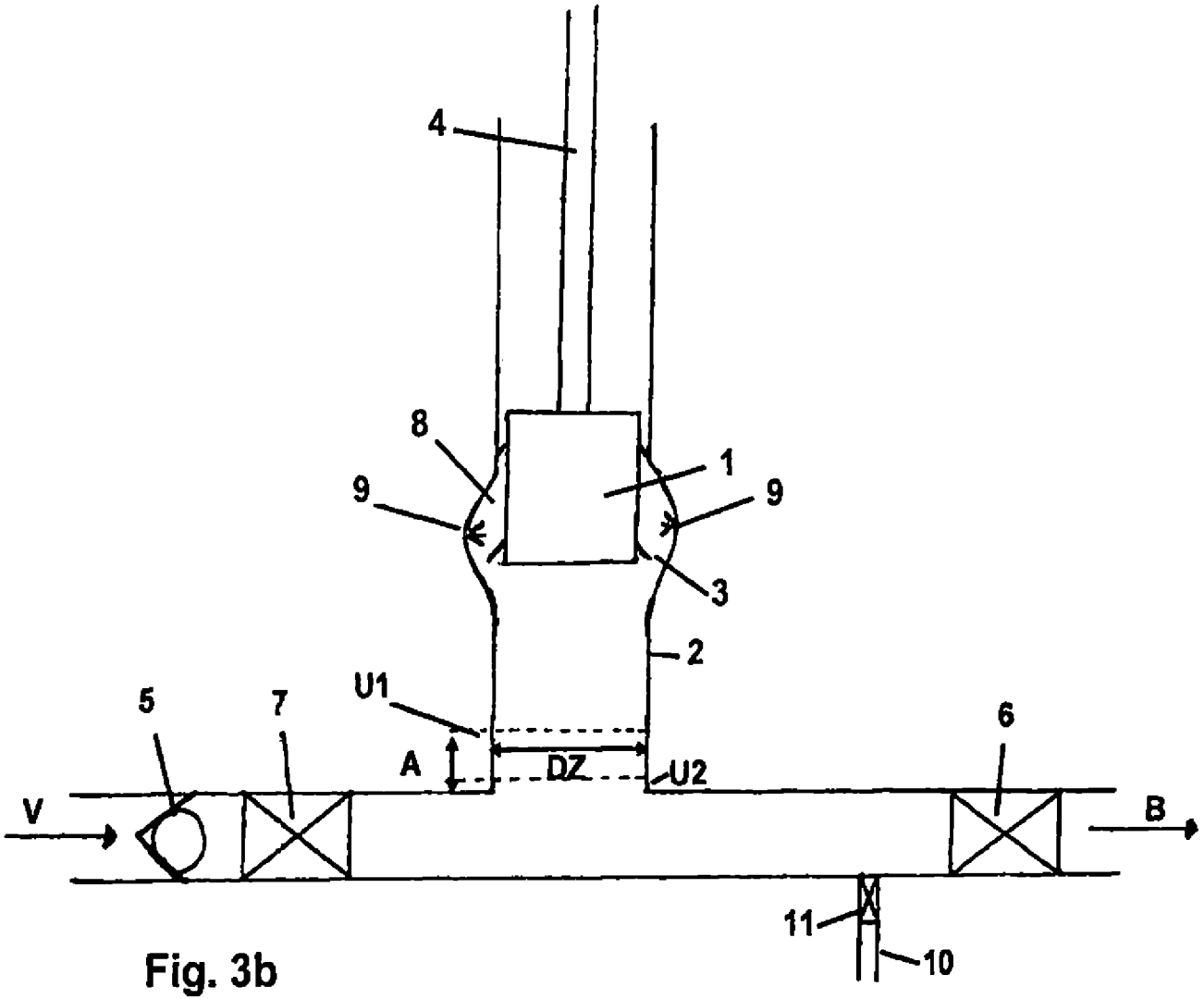

FIGS. 3*a* and 3*b* show an exemplary embodiment similar to the exemplary embodiment of FIGS. 2*a* and 2*b*, again with FIG. 3*a* showing the assembly in the working position and FIG. 2*b* showing the assembly in the cleaning position.

In the embodiment of FIG. 3, however, piston 1 is designed as longer, and beyond cleaning chamber 8, the diameter of the cylinder returns to the diameter DZ of the working area.

As is shown in FIG. 3*b*, piston 1 is moved into the cleaning position in such a way that the upper portion of the piston again forms a tight seal with the cylinder, thereby closing off cleaning chamber 8. The portion of piston 1 around seal 3, which comes into contact with the filling material, is located within cleaning chamber 8, and cleaning medium can be applied to said seal by the cleaning nozzles 9 arranged therein.

Figure 4A:
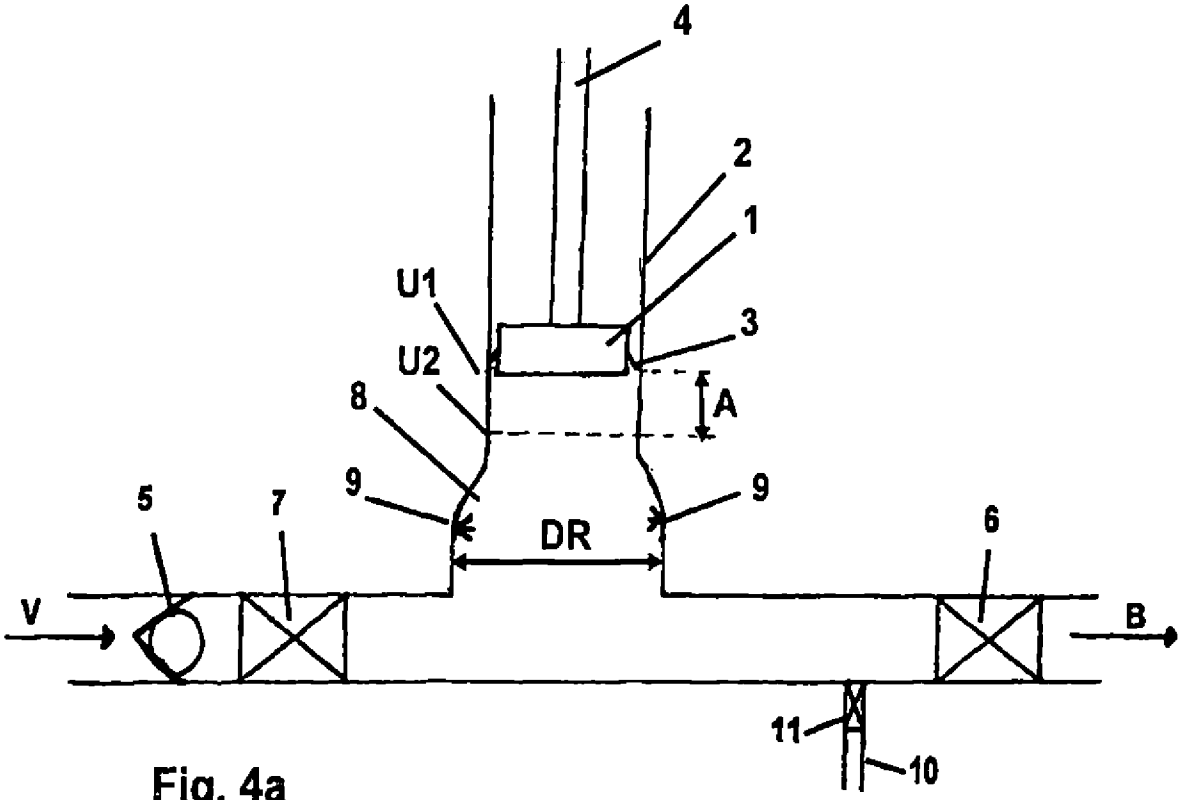
Figure 4B:
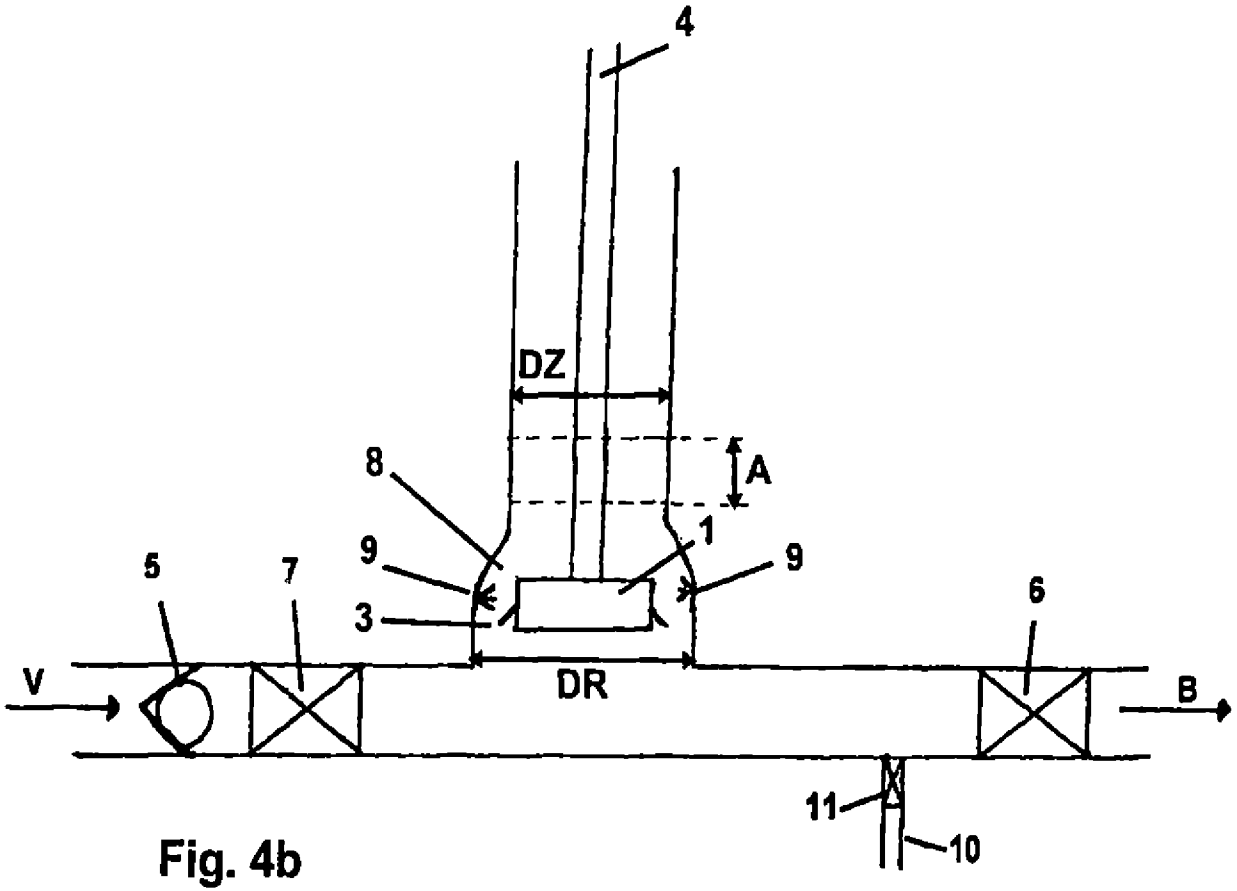

FIGS. 4*a* and 4*b* show an exemplary embodiment similar to the exemplary embodiment of FIGS. 2*a* and 2*b*, with FIG. 4*a* again showing the assembly in the working position and FIG. 4*b* showing the assembly in the cleaning position.

In contrast to FIG. 2, however, cleaning chamber 8 is located on the opposite side of working position A of piston 1 with respect to filling material line 15, i.e. piston 1 is lowered into cleaning chamber 8 for cleaning purposes.

Figure 5:
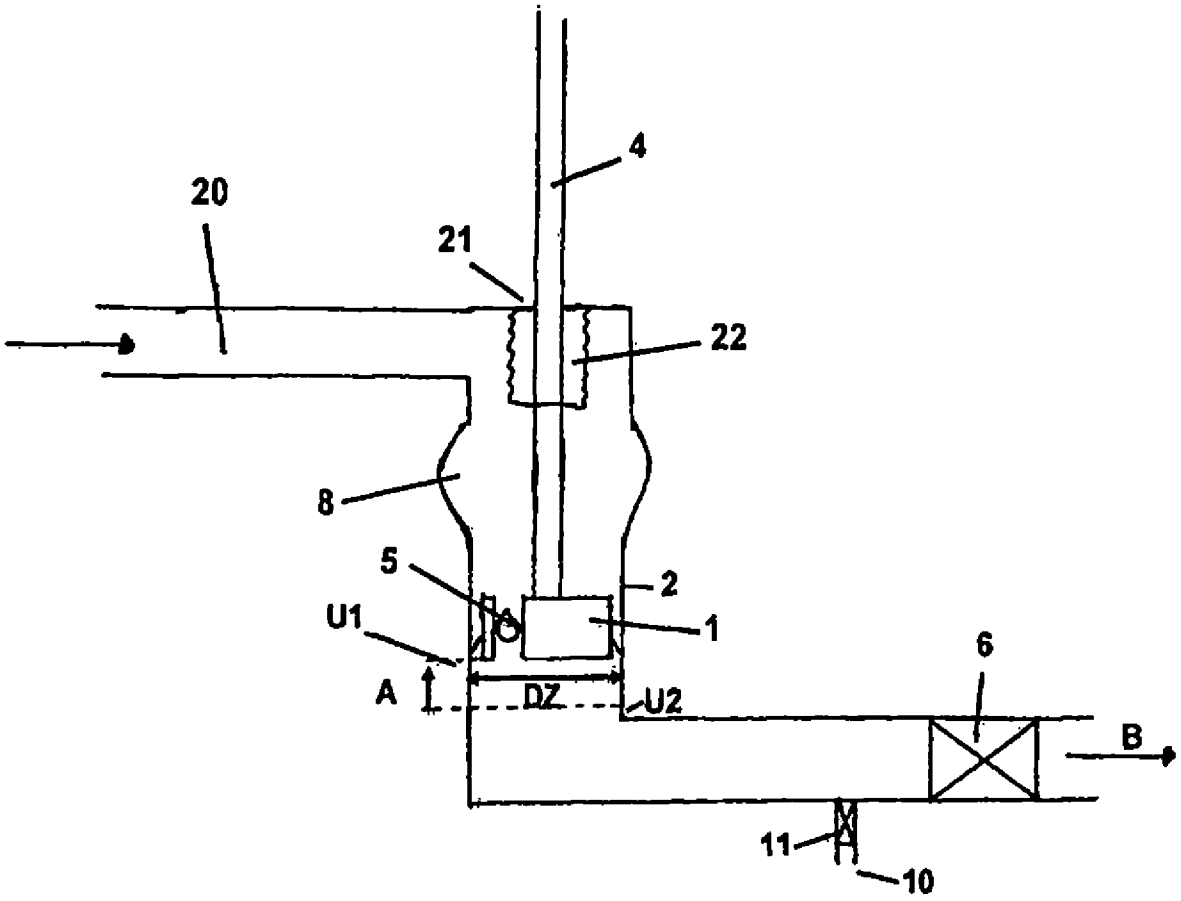
FIG. 5 is a schematic cross-sectional diagram of a fifth embodiment of a piston assembly according to the invention, in which a non-return valve is arranged in the piston.

FIG. 5 is a schematic cross-sectional diagram of a fifth embodiment of a piston assembly according to the invention, in which a non-return valve is arranged in the piston. This assembly allows the liquid to be pumped through the piston.

Piston 1 is equipped with a non-return valve 5, which in the assembly shown here permits a flow of liquid from top to bottom. Here again, filling material is fed in through feed line 20 in the direction of arrow V. As the piston moves downward, and with valve 6 open, the piston pumps filling material in the direction of arrow B, to a container not shown here. After one pumping stroke, valve 6 is closed. The piston moves upward, thereby opening valve 5 and allowing and the filling material located above piston 1 to flow through the piston. During the next pumping stroke, valve 5 closes as soon as the piston moves downward, thereby pumping filling material in the direction of the container. At the same time, fresh filling material flows out of the reservoir.

In this assembly, it is also possible to move the piston into a cleaning position in cleaning chamber 8. A separate infeed of cleaning medium into the chamber is not necessary. Instead, the entire flow path between arrows V and B can be filled with cleaning medium rather than with filling material, thereby allowing a complete cleaning to be carried out without dismantling any components. To allow the feedthrough 21 of drive 4 through the boundary wall of the flow path to also be cleaned without disassembly, a shielding element 22, for example a bellows as shown in this figure, can be expediently attached as a seal. Alternatively, a diaphragm, a rolling diaphragm or an air bellows may be used.

Figure 6:
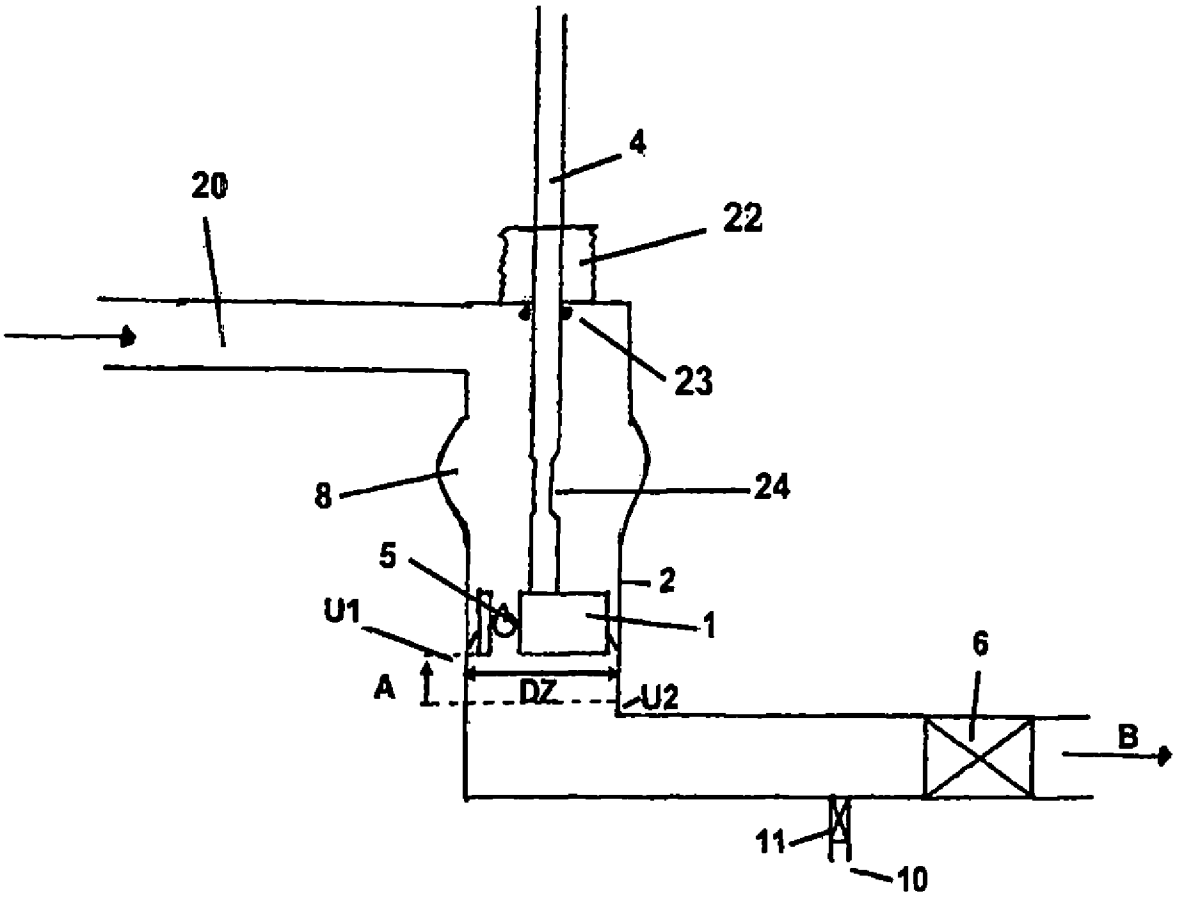
FIG. 6 is a schematic diagram of an alternative embodiment of the piston assembly of FIG. 5.

However, a shielding element 22 arranged in the flow path will be exposed to high pressure and thus to high wear. Shielding element 22 can therefore also be arranged on the outside, as shown in FIG. 6. In that case, the pressure prevailing in the flow path is absorbed by seal 23. To also make seal 23 accessible for CIP cleaning, a notch 24 is provided in drive rod 4, which is located in the region of seal 23 when the assembly is in the cleaning position, allowing cleaning medium to flow around the seal, cleaning it on all sides. Shielding element 22, configured as a bellows, seals the assembly with respect to the outside. The bellows is required only to withstand the pressure under which the assembly is cleaned. This pressure is considerably lower than the pumping pressure of the piston.

Valve 5 in the piston must likewise be suitable for CIP cleaning. Valves of this type may have a variety of designs.

Figure 7A:
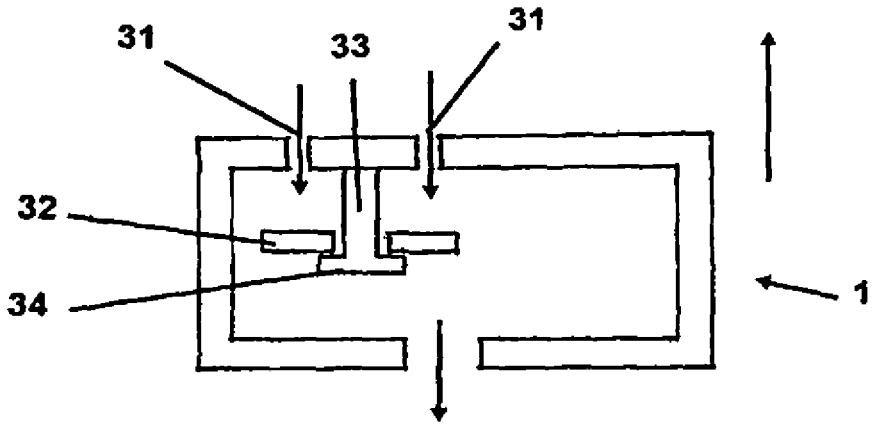
FIG. 7 is a schematic diagram illustrating one solution for a piston-arranged valve.
Figure 7B:
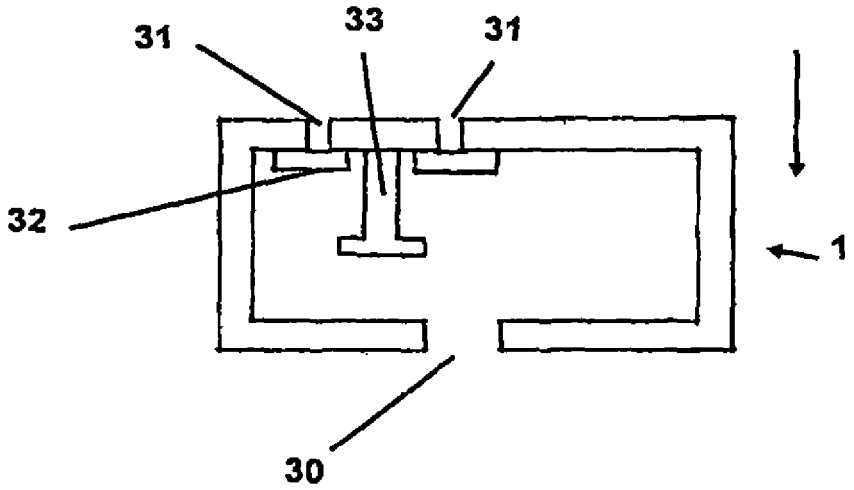

FIGS. 7*a* and 7*b* illustrate one such assembly. In this embodiment, piston 1 is hollow and has liquid passages 30 and 31 at its lower and upper ends, respectively. Located below liquid passages 31 at the upper end of piston 1 is a sealing element 32, in this case a circular plate, which is movable vertically on pin 33. When the piston moves upward, as shown in FIG. 7*a*, sealing element 32 is located on the pin at lower stop 34, and liquid is able to flow through piston 1 in the direction from top to bottom.

When the piston moves downward, as shown in FIG. 7*b*, sealing element 32 moves upward through the incipient flow of liquid and forms a tight seal with the upper end of piston 1. The liquid passages 31 are thereby closed and the piston is able to displace liquid downward.

Figure 8A:
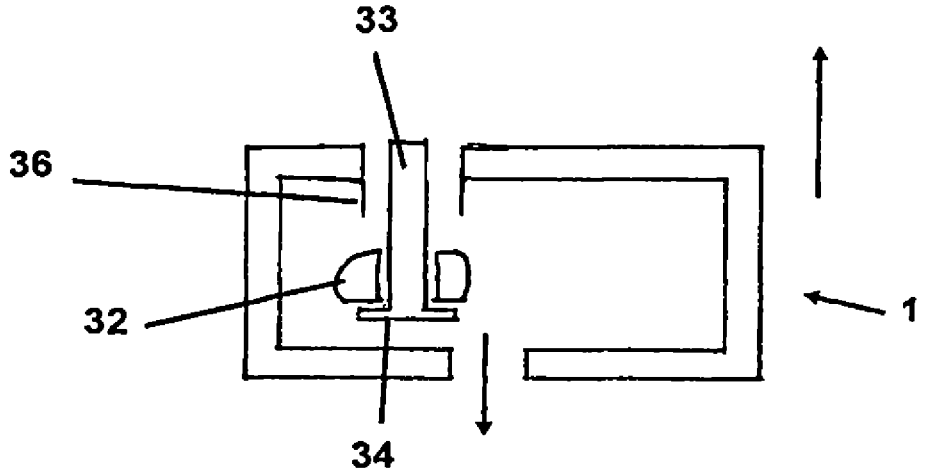
FIG. 8 is a schematic diagram illustrating a further solution for a piston-arranged valve.
Figure 8B:
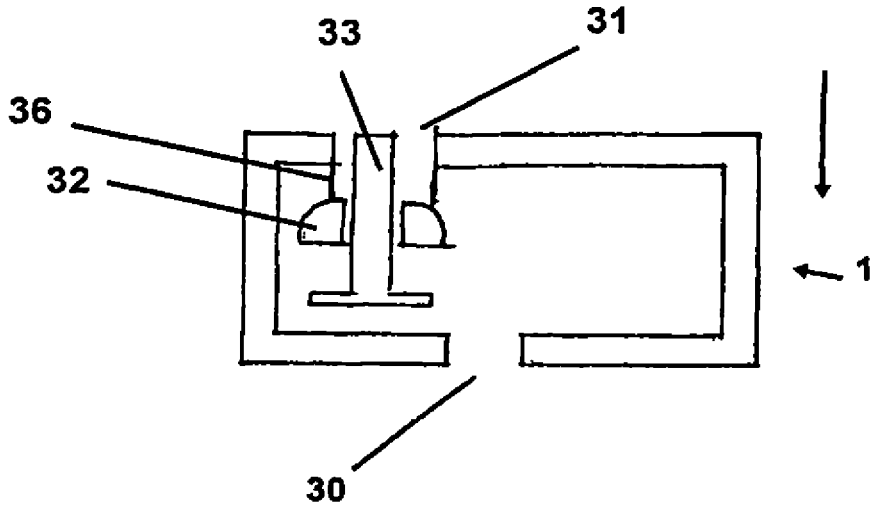

FIGS. 8*a* and 8*b* show an alternative embodiment of the assembly of FIGS. 7*a* and 7*b*. Here, sealing element 32 is a ball which forms a tight seal against a seat on a tubular projection 36. A plurality of such elements may be arranged in one piston.

The assemblies of FIGS. 7*a*, 7*b*, 8*a* and 8*b* are to be cleaned entirely by the CIP process. All clearances can be selected as large enough to ensure that when a cleaning medium flows through in the cleaning position, all components will be cleaned. In addition, the valve can also be completely cleaned in the normal operating mode by using a cleaning liquid rather than the filling material.

Figure 9:
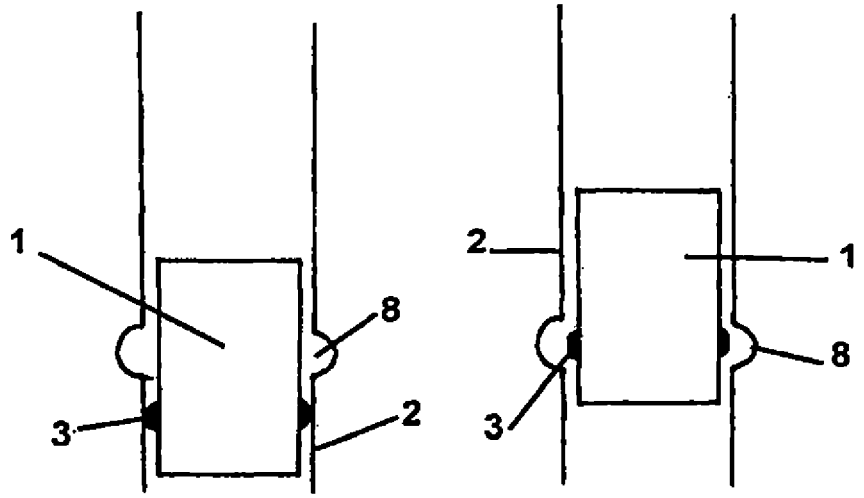
FIG. 9 is a schematic diagram illustrating one solution for a CIP-suitable seal arrangement in piston and cylinder assemblies.

One option for the CIP cleaning of circumferential seals on cylindrical bodies such as pistons may also involve providing a plurality of seals spaced apart from one another. The piston can then be brought into a position, as described above, in which the seals are located within a cleaning chamber in which the seals are not in contact with the cylinder that surrounds them in the working position, thereby allowing them to be cleaned. In this case, all seals may be located in a single cleaning chamber, as described above, or each may be located in a separate chamber, which may be a recess, for example in the form of a groove in the cylinder. Cleaning medium can penetrate between cylinder and piston and into the groove to enable cleaning. The recesses may also be arranged offset, so that a single seal can be cleaned in each recess. A solution of this type is shown in FIG. 9.

Figure 10:
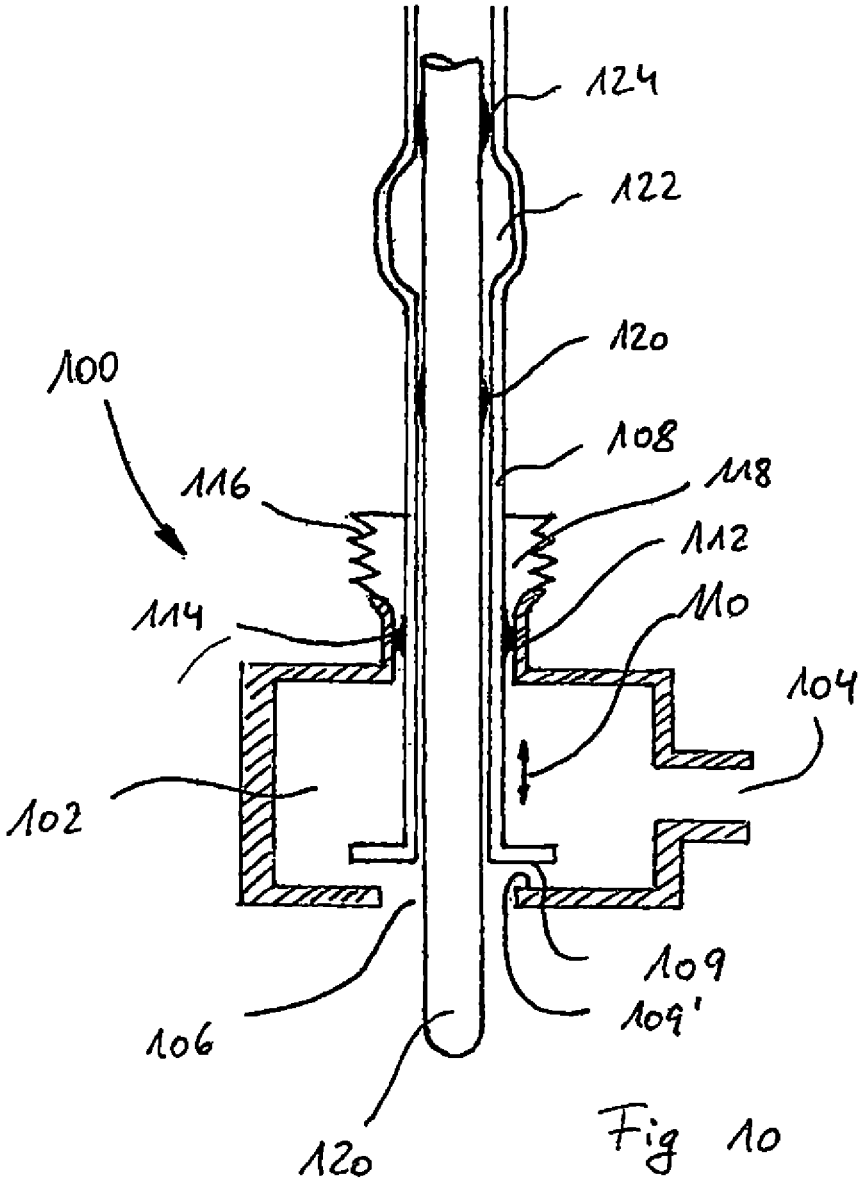
FIG. 10 is a schematic diagram illustrating a further solution for a CIP-suitable sealing arrangement in piston and cylinder assemblies.

Filling valve 6 can advantageously be integrated directly into a filling head 100 so that a minimal flow path is produced between filling valve 6 and the preform or container. An example of a filling head 100 within the scope of the invention is shown in FIG. 10.

Filling head 100 consists of a filling chamber 102 which via a teed line 104 for pressurized filling material and an annular gap 106, through which the filling material can be introduced into a preform or container (not shown).

Annular gap 106 can be sealed off by means of a valve insert 108. For this purpose, the valve insert comprises a sealing surface 109, which cooperates with a complementary sealing surface 109' that surrounds annular gap 106. Valve insert 108 can be moved in the direction of arrow 110 as shown, in order to close or open up annular gap 106.

Valve insert 108 is mounted on the upper side of pressure chamber 102 in a feedthrough 112 in the side wall of pressure chamber 102, and is sealed with respect to cylindrical feedthrough 112 by means of a seal 114. In both of the operating positions for opening up and closing annular gap 106, seal 114 is always located within feedthrough 112.

A bellows 116 is arranged above feedthrough 112 and is fixedly attached to feedthrough 112 at one end and to valve insert 108 at the other end, in each case forming a tight seal. A closed cleaning chamber 118 with a variable shape is thereby produced above seal 114.

For CIP cleaning, valve insert 108 is brought into a cleaning position in which seal 116 is arranged within cleaning chamber 118, so that an unsealed gap that connects the filling chamber with cleaning chamber 118 is opened up between feedthrough 112 and valve insert 108. In this position, filling chamber 102 and cleaning chamber 118 can be jointly flushed with suitable cleaning media, with cleaning medium flowing likewise around the surface of the valve insert, including sealing surface 109 and seal 116.

Also provided is a drawing bar 120, which is guided within valve insert 108 and is sealed in relation to the valve insert by means of a seal 122. Seal 122 is positioned so as to enable a travel path of sufficient length for the drawing bar within the valve insert. Between valve insert 108 and drawing bar 120, a gap is provided, which widens filling chamber 102 up to seal 120.

Above seal 120, an expansion is provided in valve insert 108, forming a cleaning chamber 122. To clean drawing bar 120, the drawing bar is moved upward until seal 120 is located within cleaning chamber 122 and the gap between drawing bar 120 and valve insert 108 fluidically connects filling chamber 102 with cleaning chamber 122. In this position, a second seal 124 on the drawing bar seals cleaning chamber 122 toward the top, so that the cleaning chamber, the gap between drawing bar 120 and valve insert 108, chamber 108 can be flushed and cleaned together using a suitable cleaning medium.

Advantageously, prior to the above step, the drawing bar is moved downward until seal 124 is located within cleaning chamber 122, which is then sealed toward the bottom by means of seal 122. In this position, cleaning chamber 122, which is open toward the top, can be flushed with a cleaning medium, simultaneously flushing and cleaning seal 124.

The invention claimed is:

1. A piston assembly for pumping a liquid material through a liquid line, which piston assembly is cleanable in place with a cleaning medium without disassembling the piston assembly, the piston assembly comprising:

a cylinder that defines a portion of the liquid line; and a piston that travels within the cylinder and divides the portion of the liquid line defined by the cylinder into an upstream portion relative to the piston and a downstream portion relative to the piston;

wherein the upstream portion of the liquid line defined by the cylinder is in fluid communication with a feed line for supplying the liquid material to the cylinder during pumping operation of the piston assembly and for separately supplying cleaning medium for cleaning the piston assembly to the cylinder during cleaning operation of the piston assembly, wherein, for pumping the liquid material through the liquid line, the piston is configured to travel on a working path that extends between a first inversion point and a second inversion point within a working section of the cylinder, wherein the piston forms a sealing closure with respect to the cylinder in the working section, wherein, for cleaning the piston assembly in place with the cleaning medium, the piston is movable beyond one of the two inversion points, outside of the working section, to a cleaning and/or disinfection section of the cylinder, wherein a diameter of the cylinder is enlarged in the cleaning and/or disinfection section of the cylinder such that no sealing closure is formed by the circumferential seal with respect to the cylinder in the cleaning and/or disinfection section, wherein at least two valves are arranged in the liquid line, and wherein one of the at least two valves is inside the piston and is configured to allow the liquid material supplied to the cylinder by the feed line to flow through the piston from the upstream portion of the liquid line defined by the cylinder to the downstream portion of the liquid line defined by the cylinder.

2. The piston assembly according to claim 1, wherein the cleaning and/or disinfection section of the cylinder with the enlarged diameter is enlarged by continuous arcuate transitions so that the piston is movable from the cleaning and/or disinfection section to the working section without becoming caught or jammed on an edge.

3. The piston assembly according to claim 1, wherein the section of the cylinder with the enlarged diameter is equipped with nozzles for supplying a cleaning medium.

4. The piston assembly according to claim 1, wherein the piston is equipped with a circumferential seal that forms the sealing closure with respect to the cylinder in the working section.

5. The piston assembly according to claim 4, wherein the piston and the seal are formed as an integral unit.

6. The piston assembly according to claim 1, wherein the piston is made of a plastic.

7. The piston assembly according to claim 4, wherein the cylinder, in a section opposite the working section and beyond the cleaning and/or disinfection section, has a diameter that is the same as the diameter in the working section.

8. The piston assembly according to claim 7, wherein, in the section opposite the working section and beyond the cleaning and/or disinfection section, a sealing closure is formed between the circumferential seal of the piston and the cylinder.

9. The piston assembly according to claim 1, wherein the one of the at least two valves that is inside the piston is a non-return valve.

10. The piston assembly according to claim 1, wherein the other one of the at least two valves is arranged in the liquid line downstream of the piston.

11. The piston assembly of claim 6, wherein the plastic is selected from a group consisting of polyethylene, polypropylene and polyethylene terephthalate.

* * * * *